US010329079B2

(12) United States Patent
Gardner

(10) Patent No.: US 10,329,079 B2
(45) Date of Patent: Jun. 25, 2019

(54) AEROSOL/SOLVENT DELIVERY NOZZLES

(71) Applicant: Hamilton Sundstrand Corporation, Charlotte, NC (US)

(72) Inventor: Ben D. Gardner, Colton, CA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 232 days.

(21) Appl. No.: 14/876,218

(22) Filed: Oct. 6, 2015

(65) Prior Publication Data

US 2017/0096291 A1 Apr. 6, 2017

(51) Int. Cl.

| | |
|---|---|
| ***B65D 83/28*** | (2006.01) |
| ***B05B 7/24*** | (2006.01) |
| ***B65D 83/20*** | (2006.01) |
| ***B05B 1/26*** | (2006.01) |
| ***B65D 83/68*** | (2006.01) |
| ***B05B 7/08*** | (2006.01) |

(52) U.S. Cl.

CPC ..... *B65D 83/28* (2013.01); *B05B 1/26* (2013.01); *B05B 7/0807* (2013.01); *B05B 7/2472* (2013.01); *B65D 83/20* (2013.01); *B65D 83/68* (2013.01)

(58) Field of Classification Search

CPC ..... B65D 83/28; B65D 83/68; B65D 83/20; B05B 1/26; B05B 7/2472; B05B 7/0807

USPC ..... 239/337, 549, 543, 544, 303–306, 450, 239/104, 106, 112, 418, 419, 433, 566, 239/589

See application file for complete search history.

(56) References Cited

U.S. PATENT DOCUMENTS 1,843,036 A * 1/1932 Lurry ..... B08B 9/093 239/424
2,672,187 A * 3/1954 Smith ..... F23D 14/54 239/549

(Continued)

FOREIGN PATENT DOCUMENTS

WO WO-1998/42007 A1 9/1998
WO WO-2000/30167 A1 5/2000

(Continued)

OTHER PUBLICATIONS

Jiannan Dong et al, "Desorption Electrospray Ionization of Aerosol Particles" Rapid Communications in Mass Spectrometry, vol. 21, No. 24, Dec. 30, 2007 (6 pages).

(Continued)

*Primary Examiner* — Steven J Ganey
(74) *Attorney, Agent, or Firm* — Locke Lord LLP; Scott D. Wofsy; Joshua L. Jones

(57) ABSTRACT

A delivery nozzle for aerosol and solvent includes a nozzle body defining an aerosol passage and a solvent passage therethrough. The aerosol and solvent passages each extend from an inlet end of the nozzle body to an outlet end thereof. The nozzle body can include a solid, unitary structure with the aerosol and solvent passages both defined through the solid, unitary structure. The inlet end of the nozzle body can include a mounting flange configured to mount the nozzle body in a device for delivering aerosol through the aerosol passage and for delivering solvent through the solvent passage. The solvent passage can define a smaller cross-sectional flow area than that of the aerosol passage.

12 Claims, 2 Drawing Sheets

(56) References Cited

U.S. PATENT DOCUMENTS

| | | | | |
|---|---|---|---|---|
| 3,045,925 | A * | 7/1962 | Giangualano | B65D 83/20 239/306 |
| 3,730,437 | A * | 5/1973 | Rousselot | B65D 83/682 239/544 |
| 7,303,727 | B1 | 12/2007 | Dubrow et al. | |
| 2005/0047969 | A1 | 3/2005 | Zhao et al. | |
| 2005/0092917 | A1 | 5/2005 | Hirabayashi et al. | |
| 2006/0060769 | A1 | 3/2006 | Bousse et al. | |
| 2007/0257190 | A1 | 11/2007 | Li | |
| 2011/0147576 | A1 | 6/2011 | Wouters et al. | |

FOREIGN PATENT DOCUMENTS

| | | | |
|---|---|---|---|
| WO | WO-2004/051697 | A2 | 6/2004 |
| WO | WO-2009/010379 | A2 | 1/2009 |

OTHER PUBLICATIONS

Lambert A. Doezema et al. "Analysis of Secondary Organic Aerosols in Air Using Extractive Electrospray Ionization Mass Spectrometry (EESI-MS)", RSC Advances: An International Journal to Further the Chemical Sciences, vol. 2., No. 7, Jan. 1, 2012 (9 pages).

Extended European Search Report dated Feb. 15, 2017,issued during the prosecution of European Patent Application No. EP 16192446.9 (13 pages).

European Search Report dated Feb. 11, 2019, issued during the prosecution of corresponding European Patent Application No. 16192446.9 (3 pages).

* cited by examiner

AEROSOL/SOLVENT DELIVERY NOZZLES

BACKGROUND OF THE INVENTION

1. Field of the Invention

The present disclosure relates to nozzles, and more particularly to delivery nozzles such as used in delivering solvents and aerosols.

2. Description of Related Art

A variety of devices and methods are known in the art for issuing solvents and aerosols. Of such devices, many are configured to direct a stream of solvents to come into contact with aerosols. Conventional designs utilize a relatively fragile capillary for delivering solvents under pressure, and a tube for delivering aerosols. The capillary and tube are traditionally pointed collinear or on a converging angle so that aerosol delivered from the tube comes into contact with solvent issued from the capillary.

Typically when a device as described above must be cleaned or serviced, the capillary is at risk of being damaged or broken. It may be possible to continue operating if only a small portion of the capillary is broken; however, cumulative breakage, or large single breakages tend to reduce the ability to deliver solvent to effectively encounter the aerosol.

Such conventional methods and systems have generally been considered satisfactory for their intended purpose. However, there is still a need in the art for improved aerosol/delivery nozzles. The present disclosure provides a solution for this need.

SUMMARY OF THE INVENTION

A delivery nozzle for aerosol and solvent includes a nozzle body defining an aerosol passage and a solvent passage therethrough. The aerosol and solvent passages each extend from an inlet end of the nozzle body to an outlet end thereof.

The nozzle body can include a solid, unitary structure with the aerosol and solvent passages both defined through the solid, unitary structure. The inlet end of the nozzle body can include a mounting flange configured to mount the nozzle body in a device for delivering aerosol through the aerosol passage and for delivering solvent through the solvent passage. The solvent passage can define a smaller cross-sectional flow area than that of the aerosol passage.

Each of the aerosol and solvent passages can include a respective inlet defined in the inlet end of the nozzle body and each of the aerosol and solvent passages can include a respective outlet defined in the outlet end of the nozzle body. The outlets of the aerosol and solvent passages can be closer together than are the inlets thereof to direct solvent and aerosol issued from the nozzle body to meet outside the nozzle body. The inlet of the solvent passage can include a seal for sealing pressurized passage of solvent into the solvent passage.

The nozzle body can include a chemically inert material such as a material resistant to low PH solvent passing therethrough. The nozzle body can include at least one of quartz, steel, plastic, polytetrafluoroethylene, ceramic, or silicon. The aerosol passage can be lined with an electrically conductive layer, such as a gold coating layer. A capillary can be disposed within the solvent passage.

The nozzle body can define at least one additional solvent passage, such as any of the solvent passages described above, extending from the inlet end of the nozzle body to an outlet end thereof. The nozzle body can define at least one additional aerosol passage, such as any of the aerosol passages described above, extending from the inlet end of the nozzle body to an outlet end thereof. At least one of the aerosol passage and the solvent passage can define a tortuous path.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
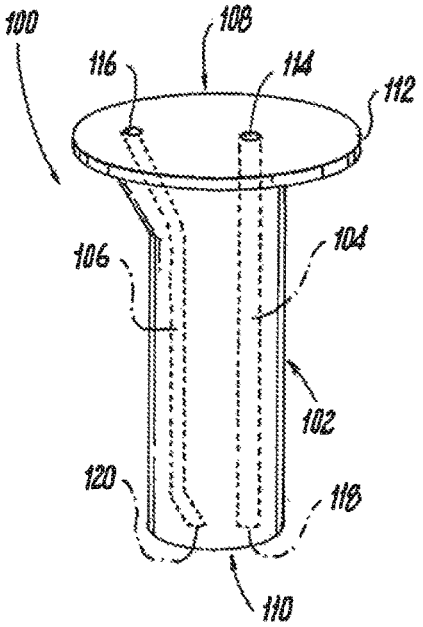
FIG. 1 is a perspective schematic view of an exemplary embodiment of a delivery nozzle constructed in accordance with the present disclosure, showing the nozzle body with the solvent and aerosol passages defined therethrough.

Reference will now be made to the drawings wherein like reference numerals identify similar structural features or aspects of the subject disclosure. For purposes of explanation and illustration, and not limitation, a partial view of an exemplary embodiment of a delivery nozzle in accordance with the disclosure is shown in FIG. 1 and is designated generally by reference character 100. Other embodiments of delivery nozzles in accordance with the disclosure, or aspects thereof, are provided in FIGS. 2-5, as will be described. The systems and methods described herein can be used to deliver solvents and aerosols, e.g., in a manner where the solvents and aerosols meet and/or are mixed.

Delivery nozzle 100 for aerosol and solvent includes a nozzle body 102 defining an aerosol passage 104 and a solvent passage 106 therethrough. The aerosol and solvent passages 104 and 106 each extend from an inlet end 108 of the nozzle body to an outlet end 110 thereof.

Nozzle body 102 includes a solid, unitary structure with the aerosol and solvent passages 104 and 106 both defined through the solid, unitary structure. Inlet end 108 of nozzle body 102 includes a mounting flange 112 configured to mount nozzle body 102 in a device for delivering aerosol through aerosol passage 104 and for delivering solvent through solvent passage 106. Solvent passage 106 defines a smaller cross-sectional flow area than that of aerosol passage 104, however those skilled in the art will readily appreciate that this is optional, and in other configurations the solvent passage can be the same size or larger than the aerosol passage, for example as described below with reference to FIG. 3.

Each of the aerosol and solvent passages 104 and 106 includes a respective inlet 114 and 116 defined in inlet end 108 of nozzle body 102 and each of the aerosol and solvent passages 104 and 106 includes a respective outlet 118 and 120 defined in outlet end 110 of nozzle body 102. The outlets 118 and 120 of the aerosol and solvent passages 104 and 106 are closer together than are the inlets 114 and 116 thereof. This convergence of aerosol and solvent passages 104 and 106 directs solvent and aerosol issued from nozzle body 102 to meet outside nozzle body 102.

Nozzle body 102 can include a chemically inert material such as a material resistant to low PH solvent passing therethrough. For example, nozzle body 102 can include at least one of quartz, steel, or silicon. Ceramics or plastics such as polytetrafluoroethylene can also be used. Aerosol passage 104 can be lined with an electrically conductive layer, such as a gold coating layer or a coating layer of any other suitable electrically conductive material, to facilitate movement of aerosol therethrough.

Figure 2:
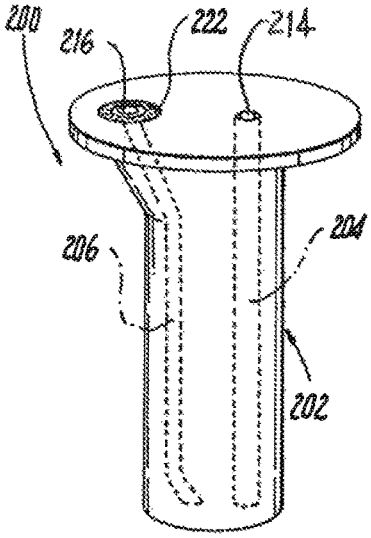
FIG. 2 is a perspective view of another exemplary embodiment of a delivery nozzle constructed in accordance with the present disclosure, showing a seal for sealing pressurized passage of solvent into the solvent passage.

Referring now to FIG. 2, another exemplary embodiment of a delivery nozzle 200 is shown, with a nozzle body 202 and aerosol and solvent passages 204 and 206 similar to those described above with respect to nozzle 100. The inlet 216 of the solvent passage 206 includes a seal 222 for sealing pressurized passage of solvent into solvent passage 206. Those skilled in the art will readily appreciate that a similar seal can optionally be used for inlet 214 of aerosol passage 204.

Figure 3:
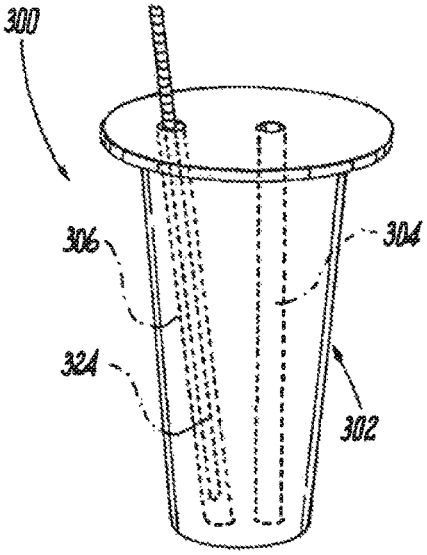
FIG. 3 is a perspective view of another exemplary embodiment of a delivery nozzle constructed in accordance with the present disclosure, showing a capillary disposed within the solvent passage.

With reference now to FIG. 3, an exemplary embodiment of a delivery nozzle 300 is shown with nozzle body 302 and aerosol passage 304 similar to nozzle 100 described above, but with an enlarged solvent passage 306, which can be up to the same size as or larger in cross-sectional flow area than aerosol passage 304. A capillary 324 can be disposed within solvent passage 306, wherein nozzle body 302 surrounds and protects the tip of capillary 324. Some or all of capillary 324 can optionally include an outer polyamide coating 326.

Figure 4:
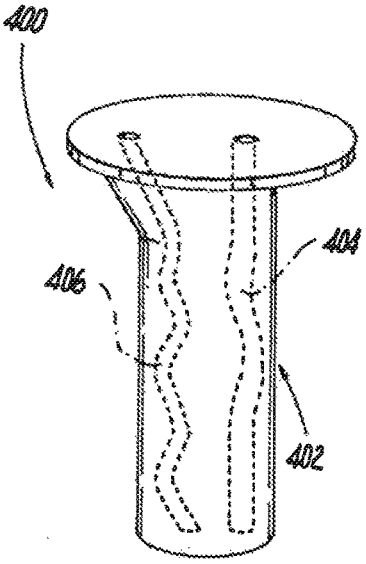
FIG. 4 is a perspective view of another exemplary embodiment of a delivery nozzle constructed in accordance with the present disclosure, showing the solvent and aerosol passages defining tortuous paths.

Referring now to FIG. 4, yet another exemplary embodiment of a delivery nozzle 400 is shown, having a nozzle body 402 similar to that described above with respect to FIG. 1. Each of the aerosol passage and the solvent passage 404 and 406 define a tortuous path. Those skilled in the art will readily appreciate that it is also possible to have only one of the passages 404 or 406 defined along a tortuous path, and that the passages can follow any arbitrary path as needed or suitable for a given application.

Figure 5:
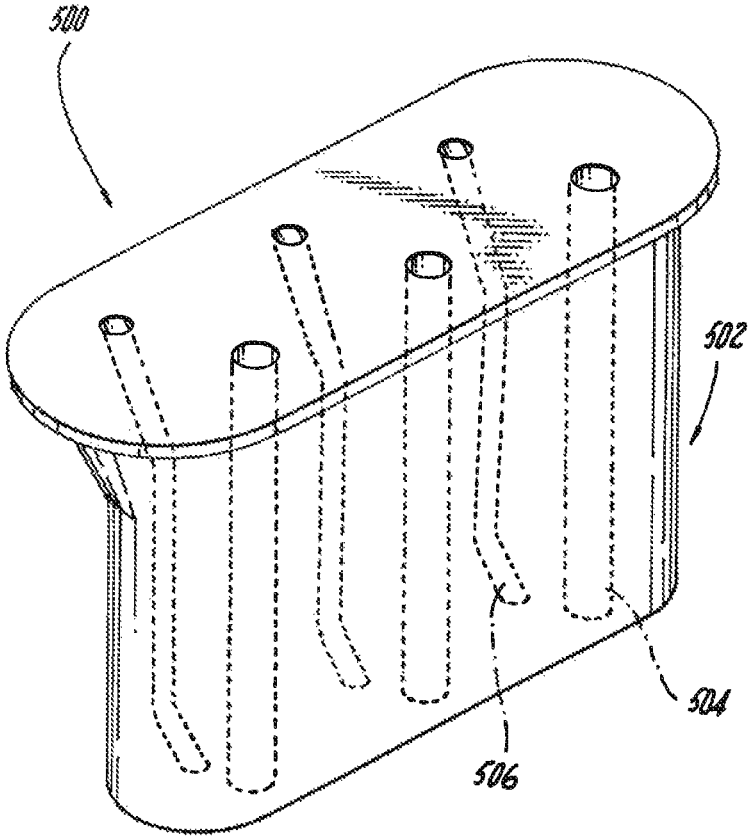
FIG. 5 is a perspective view of another exemplary embodiment of a delivery nozzle constructed in accordance with the present disclosure, showing a nozzle body with multiple solvent and aerosol passages.

With reference now to FIG. 5, an exemplary embodiment of a nozzle body 500 is shown including a nozzle body 502 with a plurality of aerosol passages 504 and a plurality of solvent passages 506 defined therethrough, each passage 504 and 506 being similar to those described above with respect to FIG. 1. This configuration allows easy installation and removal of multiple passages 504 and 506 by removing or installing a single nozzle body 502. Those skilled in the art will readily appreciate that any suitable number of passages 504 and 506 can be used, and that the number of passages 504 need not be equal to the number of passages 506.

Embodiments described herein can be made with minimal thermal mass to minimize thermal absorption, while providing improved structural integrity over the conventional configurations to reduce or prevent breakage. Those skilled in the art will readily appreciate that the tip design, e.g., outlet end 110 of delivery nozzle 100, can be customized to optimize the solvent delivery to the aerosol particles for given applications. The tip design can also be configured to control the shape of spray in the aerosol delivery, and reduce or prevent wicking over to the aerosol passage 104 from the solvent passage 106. Any suitable manufacturing process can be used to make embodiments described herein, such as additive manufacturing techniques, subtractive machining, micromachining, techniques such as used in making microelectromechanical systems (MEMS), or any other suitable technique or combination of techniques.

The methods and systems of the present disclosure, as described above and shown in the drawings, provide for delivery nozzles with superior properties including extended useful life compared to traditional delivery nozzles. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A delivery nozzle for aerosol and solvent comprising: a nozzle body defining an aerosol passage and a solvent passage therethrough, wherein the aerosol and solvent passages each extend from an inlet end of the nozzle body to an outlet end thereof, wherein the inlet end of the nozzle body includes a mounting flange configured to mount the nozzle body in a device for delivering aerosol through the aerosol passage and for delivering solvent through the solvent passage, wherein inlets of the aerosol passage and solvent passage are both defined in the mounting flange and face away from the outlet end, and wherein the aerosol and solvent passages each include an outlet in the outlet end of the nozzle body, wherein the outlets face away from the inlet end and in an opposite direction from that of the inlets.

2. The delivery nozzle as recited in claim 1, wherein the nozzle body includes a solid, unitary structure with the aerosol and solvent passages both defined through the solid, unitary structure.

3. The delivery nozzle as recited in claim 1, the solvent passage defines a smaller cross-sectional flow area than that of the aerosol passage.

4. The delivery nozzle as recited in claim 1, wherein the nozzle body includes a chemically inert material.

5. The delivery nozzle as recited in claim 1, wherein the nozzle body includes a material resistant to low PH solvent passing therethrough.

6. The delivery nozzle as recited in claim 1, wherein the nozzle body includes at least one of quartz, steel, plastic, polytetrafluoroethylene, ceramic, or silicon.

7. The delivery nozzle as recited in claim 1, wherein the solvent passage is a first solvent passage, wherein the nozzle body defines at least one additional solvent passage extending from the inlet end of the nozzle body to an outlet end thereof.

8. The delivery nozzle as recited in claim 1, wherein the aerosol passage is a first aerosol passage, wherein the nozzle body defines at least one additional aerosol passage extending from the inlet end of the nozzle body to an outlet end thereof.

9. The delivery nozzle as recited in claim 1, wherein at least one of the aerosol passage and the solvent passage defines a tortuous path.

10. A delivery nozzle for aerosol and solvent comprising:

a nozzle body defining an aerosol passage and a solvent passage therethrough, wherein the aerosol and solvent passages each extend from an inlet end of the nozzle body to an outlet end thereof, wherein the inlet end of the nozzle body includes a mounting flange configured to mount the nozzle body in a device for delivering aerosol through the aerosol passage and for delivering solvent through the solvent passage, wherein inlets of the aerosol passage and solvent passage are both defined in the mounting flange, wherein each of the aerosol and solvent passages includes a respective inlet defined in the inlet end of the nozzle body, wherein each of the aerosol and solvent passages includes a respective outlet defined in the outlet end of the nozzle body, and wherein the outlets of the aerosol and solvent passages are closer together than are the inlets thereof to direct solvent and aerosol issued from the nozzle body to meet outside the nozzle body.

11. A delivery nozzle for aerosol and solvent comprising:

a nozzle body defining an aerosol passage and a solvent passage therethrough, wherein the aerosol and solvent passages each extend from an inlet end of the nozzle body to an outlet end thereof, wherein the inlet end of the nozzle body includes a mounting flange configured to mount the nozzle body in a device for delivering aerosol through the aerosol passage and for delivering solvent through the solvent passage, wherein inlets of the aerosol passage and solvent passage are both defined in the mounting flange, wherein each of the aerosol and solvent passages includes a respective inlet defined in the inlet end of the nozzle body, wherein the inlet of the solvent passage includes a seal for sealing pressurized passage of solvent into the solvent passage.

12. A delivery nozzle for aerosol and solvent comprising:

a nozzle body defining an aerosol passage and a solvent passage therethrough, wherein the aerosol and solvent passages each extend from an inlet end of the nozzle body to an outlet end thereof, wherein the inlet end of the nozzle body includes a mounting flange configured to mount the nozzle body in a device for delivering aerosol through the aerosol passage and for delivering solvent through the solvent passage, wherein inlets of the aerosol passage and solvent passage are both defined in the mounting flange, wherein at least one of:

the aerosol passage is lined with an electrically conductive layer, the aerosol passage is lined with a gold coating layer, and/or a capillary is disposed within the solvent passage.

* * * * *